United States Patent [19]

Fogle

[11] 3,964,558

[45] June 22, 1976

[54] FLUID ACTUATED DOWNHOLE DRILLING DEVICE

[75] Inventor: Stephen Fuller Fogle, Houston, Tex.

[73] Assignee: Texas Dynamatics, Inc., Dallas, Tex.

[22] Filed: Nov. 13, 1974

[21] Appl. No.: 523,218

[52] U.S. Cl. ..... 175/107; 415/502

[51] Int. Cl.[2] ..... E21B 3/08

[58] Field of Search ..... 415/502; 417/405; 175/95, 96, 107

[56] References Cited

UNITED STATES PATENTS

| | | | |
|---|---|---|---|
| 2,925,252 | 2/1960 | Minor | 175/95 |
| 3,088,529 | 5/1963 | Cullen et al. | 175/107 |
| 3,112,801 | 12/1963 | Clark et al. | 175/107 |
| 3,249,162 | 5/1966 | Brown | 175/107 X |
| 3,356,338 | 12/1967 | Ioanesyan et al. | 415/502 X |
| 3,728,040 | 4/1973 | Ioanesian et al. | 415/502 X |
| 3,766,992 | 10/1973 | Tiraspolsky et al. | 415/502 X |
| 3,802,515 | 4/1974 | Flamand et al. | 415/502 X |
| 3,840,080 | 10/1974 | Berryman | 175/107 |
| 3,866,678 | 2/1975 | Jeter | 166/66 |

FOREIGN PATENTS OR APPLICATIONS

| | | | |
|---|---|---|---|
| 120,189 | 7/1957 | U.S.S.R. | 175/95 |

*Primary Examiner*—James A. Leppink

[57] ABSTRACT

A downhole fluid powered mover for use in earth bore holes having a fluid turbine to produce torque and a positive displacement fluid motor to regulate the speed of an output shaft connected to both turbine and motor. Alternate embodiments include an overrunning clutch to aid in start-up of the turbine and to prevent overspeed of the turbine.

5 Claims, 2 Drawing Figures

FLUID ACTUATED DOWNHOLE DRILLING DEVICE

FOREWORD

The present invention relates to downhole bit driving, fluid powered prime movers, and more particularly a controlled speed prime mover powered by drilling fluid. Downhole drill bit driving motors of the positive displacement type and turbodrills are in common use but cause problems. The popular Moineau type positive displacement motor has a limited torque output and turbines that produce high torque are prone to turn too fast at no load conditions. Economic drilling requires high torque, yet high torque turbines that run at high speed with no load damage a rock bit before enough bit load can be applied to slow the turbine down.

Turbodrills designed for high torque with sliding bearings often fail to start down hole. A device is needed to assure starting of such turbodrills.

Turbodrills that produce high torque and have a tendency to run too fast at no load conditions need a brake or some form of speed control until the torque consumed by a drill bit is sufficient to slow a turbodrill down.

The proposed prime mover combines the qualities of a positive displacement motor and a turbodrill to produce high output torque with controlled no-load speed. Since the positive displacement motor connected to a turbine shaft must control speed at times by acting as a pump to consume power from the turbine, the term pump and motor will hereinafter be used interchangeably.

DETAILED DESCRIPTION OF DRAWINGS

Figure 1:
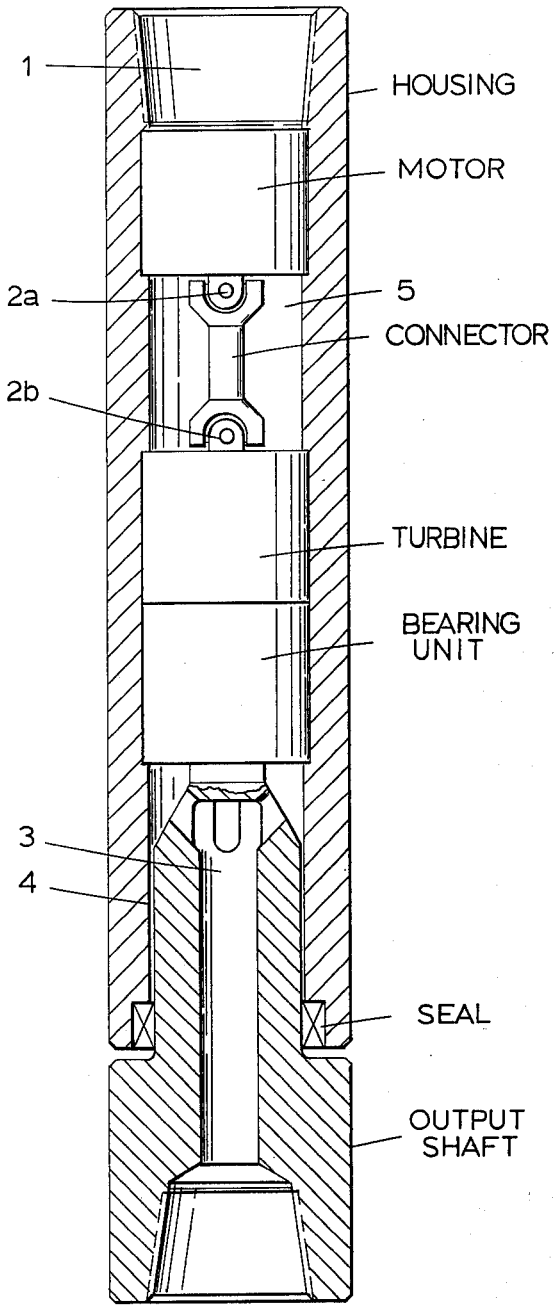
FIG. 1 is a vertical view partly in section and partly in elevation of the preferred embodiment of the device of this invention.

FIG. 1 is the preferred embodiment of the fluid powered prime mover of this invention. The housing is part of a drill string having tool joint 1 to attach it to the drill string. A positive displacement motor is situated within the housing. Fluid flowing down the drill string enters and flows through the motor, causing it to rotate. The motor rotates with a speed proportional to the rate of flow of the fluid. Fluid emerging from the positive displacement motor flows through bore 5 into a fluid turbine. A connector which rotationally connects the rotor of the positive displacement motor to the shaft of the turbine also extends through bore 5.

Fluid moving through bore 5 flows through the turbine to produce torque by interaction with the turbine blading (not shown).

The bearing unit contains thrust bearings primarily and may be above or below either turbine or motor. Fluid moving downward through motor and turbine causes a downthrust usually proportional to the hydraulic power being expended in the system. When drilling with a drill bit attached to the output shaft, bit load acts upwardly on the shaft. The bearing unit provides axial support while allowing rotation of the output shaft and related parts.

A transition unit 3 allows fluid to flow from outside the output shaft to a bore inside the output shaft so that the fluid may be discharged through a bit attached to the output shaft (not shown).

A shaft driven by motor and turbine extends from the housing through a sealed lower opening. The seal is required to prevent the escape of drilling fluid from the space between the housing and the output shaft. Radial bearing 4 stabilizes the output shaft.

Since the motor has a tendency to rotate at a fixed speed with a fixed fluid flow and the turbine tends to operate at a speed dependent upon torque output, the motor must act as a pump to prevent overspeed and as a motor to prevent stalling of the turbine. When functioning as a speed limiter or brake, the motor will be driven by the turbine to apply forward torque which will cause a pressure increase in fluid moving down through the motor. When bit load and resulting torque tends to reduce the speed of the system, the turbine will tend to slow down. The motor will tend to urge the turbine to the speed of the motor and, hence, will consume hydraulic power. This will cause a pressure reduction in fluid moving through the motor. The amount of change in pressure in fluid moving through the motor will be proportional to torque required to drive the drill bit and this will be detectable at the earth surface in the plumbing providing fluid power to the prime mover down hole. Bit load can, hence, be adjusted at the surface to produce the desired pressure drop through the prime mover. The ideal drilling situation should result when the motor is producing a safe rated output.

If the positive displacement motor is of the Moineau type, an orbiting action of the rotor occurs. The two universal joints 2*a* and 2*b* permit the connector to accommodate such orbiting action. If a fluid motor is used that has an eccentric rotor, the universal joints or the equivalent are used. If a motor is used with a central spinning non-orbiting rotor, the universal joints may be omitted and, if desired, the motor may be situated below the turbine.

Figure 2:
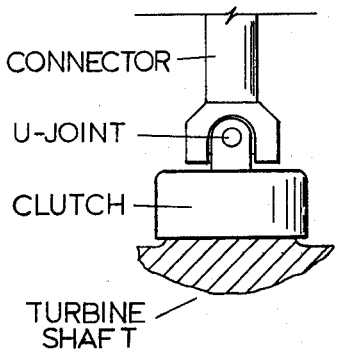
FIG. 2 is a vertical view partly in section and partly in elevation of a broken away portion of the device of FIG. 1 showing an alternate component.

FIG. 2 represents a one-way overrunning clutch arrangement to be optionally used between the motor and the turbine. The clutch may be oriented such that the motor forces the turbine to start but allows the turbine to run faster than the motor or it may be oriented to allow the turbine to run slower than the motor, but will not allow the turbine to run faster than the motor. The clutch in the second case is more useful to prevent high speed damage to roller rock bits as drilling begins.

The connector extends to the motor of FIG. 1. The universal joint is needed only if a Moineau motor or an eccentric rotor is used. The one-way overrunning clutch is shown situated between the connector and the upper end of the turbine shaft. The clutch, of course, can be situated anywhere in the drive train between motor and turbine.

Fluid motors of the positive displacement type are well established in the art. Fluid turbines are well established in the art. Bearings for axial and radial control of moving parts are well established in the art, and fluid closures or seals are common. Such common features are not detailed.

It is to be understood that the bearing unit may be an integral unit with the turbine or motor, it may be a separate unit as shown, or the individual bearings may be distributed about the rotating parts of the prime mover. The term "bearing unit" may be regarded as symbolic and not in a limiting sense.

It is currently common practice to seal a portion of the bearing complement of downhole motors into a separate annular enclosure about the lower end of the drive shaft. The thrust bearings are usually in the enclosure and the enclosure is usually sealed so that drilling fluid does not intrude into the region of the thrust bearings which are bathed in lubricant. The bearing unit of FIG. 1 may be such an arrangement.

In the use of a Moineau motor attached rotationally to the top of the turbine, a bearing unit at the top of the turbine may be used to better cope with the radial loads produced by an orbiting rotor in the Moineau motor. Such placement is within the scope of the invention.

I claim:

1. A prime mover for downhole use to convert fluid power to rotational power in earth bore hole operations comprising; a housing with a top and a bottom end having means at the top to attach to a drill string with a bore through which fluid moving down the drill string will flow, a hydro-mechanical energy converter means to transmit energy between a moving fluid stream and a rotating shaft with a reasonably consistant ratio between shaft rotation rate and rate of flow of fluid through said converter means (a positive displacement fluid motor having a rotor and a stator) situated within said housing with such fluid channels that at least part of the fluid moving through said housing will move through said converter means (motor to produce rotational speed controlling effort in both rotational directions), a fluid turbine having a rotor situated in and axially and radially supported for rotation within the bore of said housing (for rotation about the general centerline of said housing), and a stator, the turbine having fluid channels through which at least part of said fluid moving down the drill string flows to produce rotational effort, means extending from the lower end of said housing to drive a drill bit, means to conduct the rotational motion (effort) of said shaft (motor) and said rotor (turbine) to said bit driving means such that said shaft (motor), said rotor (turbine) and said bit driving means rotate with a reasonably fixed speed relationship to the rate of flow of fluid moving through said converter means. (whereby with a fixed fluid flow rate a reasonably fixed rotational speed of said bit driving means is accomplished.)

2. The device of claim 1 in which said converter means (fluid motor) is a Moineau hydro-mechanical machine (motor) and in which said means to conduct the rotational motion (effort) from said converter means (motor) includes a flexible coupling system to permit the shaft (rotor) to orbit the housing (motor) centerline.

3. The device of claim 1 further including a one-way overrunning clutch connected rotationally to the shaft (rotor) of said converter means (motor) such that the turbine cannot run slower than a preselected speed relationship to said converter means (motor) but such that said turbine can run faster than a preselected speed relationship to said converter means (motor) so that said turbine is urged to start by said converter means (motor) but said turbine is free to run up to a higher speed not limited by said converter means (motor).

4. The device of claim 1 further including an overrunning clutch connected rotationally to the shaft (rotor) of said converter means (motor) such that said turbine cannot rotate faster than a preselected speed relationship to said converter means (motor) but can rotate slower than a preselected speed relationship to said converter means (motor) so that said turbine can be stalled by overload without damaging said converter means (motor) but cannot run above a certain preselected speed relationship to said converter means (motor) due to the braking effort of said converter means (motor), which functions as a pump to act as a brake, when said turbine tends to overspeed.

5. The device of claim 1 having a closure to prevent the escape of drilling fluid between said housing and said output shaft.

* * * * *